US009179521B2

(12) United States Patent
Böckle

(10) Patent No.: US 9,179,521 B2
(45) Date of Patent: Nov. 3, 2015

(54) INTERFERENCE-FREE LIGHT-EMITTING MEANS CONTROL

(75) Inventor: Reinhard Böckle, Mäder (AT)

(73) Assignee: TRIDONIC GMBH & CO KG, Dornbirn (AT)

( * ) Notice: Subject to any disclaimer, the term of this patent is extended or adjusted under 35 U.S.C. 154(b) by 309 days.

(21) Appl. No.: 13/884,500

(22) PCT Filed: Nov. 4, 2011

(86) PCT No.: PCT/EP2011/069456

§ 371 (c)(1),
(2), (4) Date: Jul. 22, 2013

(87) PCT Pub. No.: WO2012/062664

PCT Pub. Date: May 18, 2012

(65) Prior Publication Data

US 2013/0293132 A1 Nov. 7, 2013

(30) Foreign Application Priority Data

Nov. 9, 2010 (DE) ..... 10 2010 043 613

(51) Int. Cl.
*H05B 37/02* (2006.01)

(52) U.S. Cl.
CPC ..... *H05B 37/02* (2013.01); *H05B 37/0263* (2013.01)

(58) Field of Classification Search
CPC ..... H05B 37/0245; H05B 37/0263
See application file for complete search history.

(56) References Cited

U.S. PATENT DOCUMENTS

| | | | | |
|---|---|---|---|---|
| 4,939,710 | A * | 7/1990 | Fuji et al. | 369/13.02 |
| 5,640,143 | A | 6/1997 | Myron et al. | |
| 6,445,144 | B1 * | 9/2002 | Wuidart et al. | 315/310 |
| 7,067,991 | B2 | 6/2006 | Hsu et al. | |
| 8,810,148 | B2 * | 8/2014 | Boeckle | 315/289 |
| 2008/0203936 | A1 | 8/2008 | Mariyama et al. | |

FOREIGN PATENT DOCUMENTS

| | | | |
|---|---|---|---|
| DE | 19748007 | A1 | 5/1999 |
| EP | 2104401 | A1 | 9/2009 |
| WO | 2009/156952 | A1 | 12/2009 |
| WO | 2010027254 | A1 | 3/2010 |

* cited by examiner

*Primary Examiner* — Jeffrey Zweizig
(74) *Attorney, Agent, or Firm* — Volpe and Koenig, P.C.

(57) ABSTRACT

An operating device (1) for light-emitting device (5), where the operating device (1) has an interface circuit (2) and a drive circuit (3), where the interface circuit (2) generates an interface signal (21, 31, 41, 51) depending on a control signal (Vn, 10), and where the drive circuit (3) drives at least one light-emitting device (5) depending on the interface signal (21, 31, 41, 51). The control signal (Vn, 10) is an AC voltage control signal generated outside the operating device (1). The interface circuit (2) detects overshooting of an upper threshold value of only one of two half-waves of the control signal (Vn, 10), and the interface circuit (2) generates a first signal pulse (22, 55) in the interface signal (21, 31, 41, 51) for each detection of overshooting of an upper threshold value and identifies overshooting of a lower threshold value for the other half-wave.

14 Claims, 9 Drawing Sheets

INTERFERENCE-FREE LIGHT-EMITTING MEANS CONTROL

The invention relates to a controller for controlling lamps and to a method for controlling light sources.

In addition to traditional direct wired sources, many controllers are known which can be used in order to control light means. In such conventional controllers, a control signal is usually transmitted from a switch to a controller. The controller receives the signal and implements a corresponding control of the lamp. This may mean switching it on or off, but it could also mean a dimming operation, The control signal is in this case typically either the line voltage or a digital signal. Standardized transmission methods, for example DALI, are often used.

It is further also known that different control signals can be used, for example DALI and line voltage, with one device. This allows for a great flexibility of the application of the controller. In particular when long line lengths are used through which the control signal is transmitted, this results in unreliable switching performance because capacitive or inductive interference can cause erroneous switching operations.

German patent application DE 197 48 007 A1, for example, describes a conventional control device which is provided with an interface circuit. The disadvantage in this case is that higher implementation expenses are required.

An objective of the invention is to indicate a controller for lighting means and a method for operating lighting means which enables a safe switching performance with low implementation expenses, in particular with long line lengths.

This objective is achieved with a controller according to the invention through the characteristics of the independent claim 1 and through the characteristics of the independent claim 14, and for the method through the characteristics of the independent claim 8. Advantageous embodiments are the subject of the dependent claims referred to in this text.

A controller according to the invention for a lighting means comprises an interface circuit and a drive circuit. The interface circuit generates an interface signal in response to a control signal. The control signal is in this case alternating voltage signal generated outside of the control device. The interface circuit detects that the upper threshold of a first signal pulse has been exceeded in the interface signal for only one of two half-waves of the control signal and generates for each detection of exceeded upper threshold a first signal pulse in the interface and detects that the low threshold of the other of the two half-waves has been exceeded. This enables a simple and at the same time safe interference-free evaluation of the control signal.

The invention also relates to a controller for lighting means, wherein the controller is equipped with an interface circuit and with a drive circuit, wherein the interface circuit generates an interface signal in response to the drive circuit, and wherein the drive circuit drives at least one lighting means in response to the interface signal, so that a control signal is generated outside of the controller, the interface device detects that the low threshold has been exceeded for at least the majority of the duration of one of two half-waves of the control signal, and the interface circuit generates for each detection of exceeded lower threshold a second signal pulse, so that the interface signal is generated, and with a repeated succession of a plurality of such second signal pulses, the application of a control signal is detected.

The interface circuit is further advantageously provided with a peak detection circuit which can detect that the upper threshold value has been exceeded and optionally can also detect peak values. In addition, the interface device contains a zero-crossing recognition circuit which can detect that the lower threshold value has been exceeded and optionally also detect zero-crossing points of the control signal. An additional improvement of the recognition of the switching states is thus made possible.

The invention will now be described based on the drawings in which is illustrated, by way of an example, an advantageous embodiment of the invention. The figures show the following:

Figure 1:
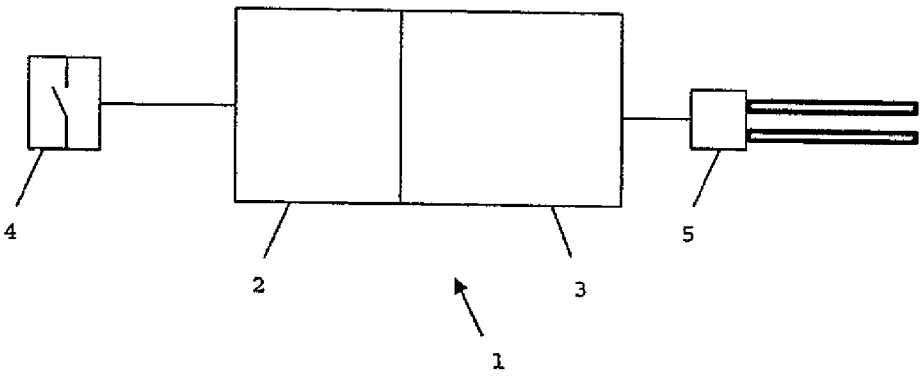
Fig. 1 (PRIOR ART)
FIG. 1 shows an example of a lighting system.

The underlying problems relating to this invention will be explained first with reference to FIGS. 1-3, which illustrate the construction and the operation of a controller serving as an example. After that, the construction and the operation of the controller according to the invention will be described by means of FIGS. 4-8.

Next, the method according to the invention will be explained in more detail based on FIG. 9. Identical elements which have been shown in partially similar illustrations will not be illustrated and described repeatedly.

An exemplary lighting system contains a push button 4, a controller 1 and a lighting means 5. Instead of a push button 4, it is also possible to use a switch or another input device. The controller 1 is connected with the lighting means 5. The lighting means 5 can be for example, a customary incandescent lamp or a fluorescent lamp, or one or several light-emitting diodes, or LEDs. The controller 1 includes an interface circuit 2 and a drive circuit 3. The push button 4 is connected with the interface circuit 2 of the controller 1. The interface circuit 2 and the drive circuit 3 of the controller 1 are mutually connected. The lighting means 5 is connected with the drive circuit 3 of the controller 1. The push button 4 and the controller 1 are connected to each other by a line. Furthermore, the controller 1 can be permanently connected to a supply connection with a power supply, so that it is supplied from the drive circuit 3 in order to provide power for the lighting means 5.

The push button 4 connects, as soon as it is pressed, the line voltage with the interface circuit 2 of the controller 1. When it is not pressed, the line between the push button 4 and the interface device 2 is open. Interference can occur in this line both when the switch 4 is activated and when it is not activated.

The interface circuit 2 evaluates the signals on the line and determines in this manner the switching operations of the push button 4. Based on these switching operations, the interface circuit 2 generates an interface signal and forwards it to the drive circuit 3. In response to the interface signal, the drive circuit then drives the lighting means 5. The interface circuit 2 determines in this case only the switching states of the push button 4 and converts them into the interface signal. The drive switch thus determines from the switching states communicated to it in the interface signal the switching operations to be carried out. The drives circuit 3 thus uses for example the duration of the activation period, the activation sequence, or the rhythm of the activation as instructions for the control operation to be performed. This interface signal thus provides for example a reference value for the drive circuit 3.

Figure 2:
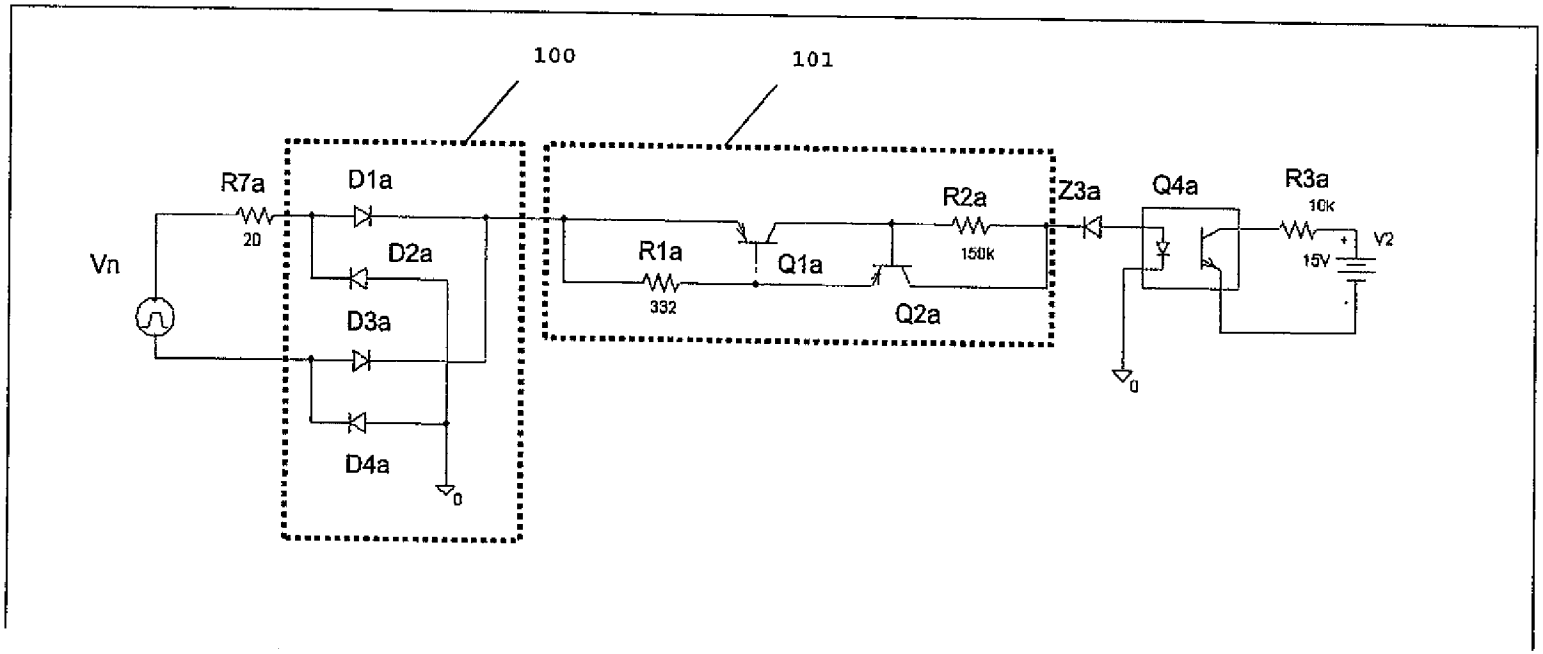
Fig. 2 (PRIOR ART)
FIG. 2 shows an example of a controller.

FIG. 2 shows an example of an interface circuit, which could be for example employed in the lighting system indicated in FIG. 1. The switched supply voltage Vn is supplied via a resistor R7*a*, for example with 20Ω, to a rectifier circuit 100. The rectifier circuit 100 in this case consists of four diodes D1*a*, D2*a*, D3*a*, D4*a*. These diodes are connected in a conventional bridge rectifier circuit to ground. The rectified signal is supplied to a zero crossing detection switch 101. This switch consists of two transistors Q1*a*, Q2*a* and two resistors R1*a*, R2*a*. The emitter of the transistor Q1*a* and the resistor R1*a* with for example 332Ω are connected directly to the rectified signal. The resistor R1*a* is further connected with the base of the transistor Q1*a* and with the emitter of the transistor Q2*a*. Further, the collector of the transistors Q1*a* is connected with the base of the transistor Q2*a* and with the resistor R2*a* with for example 150 kΩ. The collector of the transistor Q2*a* is connected to the other side of the resistor R2*a*. At this point, the signal exits the zero crossing detection circuit. This signal is supplied through another diode 23*a* to an optocoupler Q4*a*. This optocoupler is connected through another resistor R3*a* with for example 10 kΩ to supply voltage V2 with for example 15V. The interface signal can be extracted for example on the secondary side, not shown here, of the optocoupler Q4*a*.

The zero crossing detection circuit 1-1 generates a pulse at each zero crossing of the incoming signal. A pulse having a different width will be produced depending on the gradient of the voltage passing through the zero point. A similar pulse typical lasts for a period of 100 microseconds. Such a pulse can be easily transmitted with the optocoupler Q4*a*.

Figure 3:
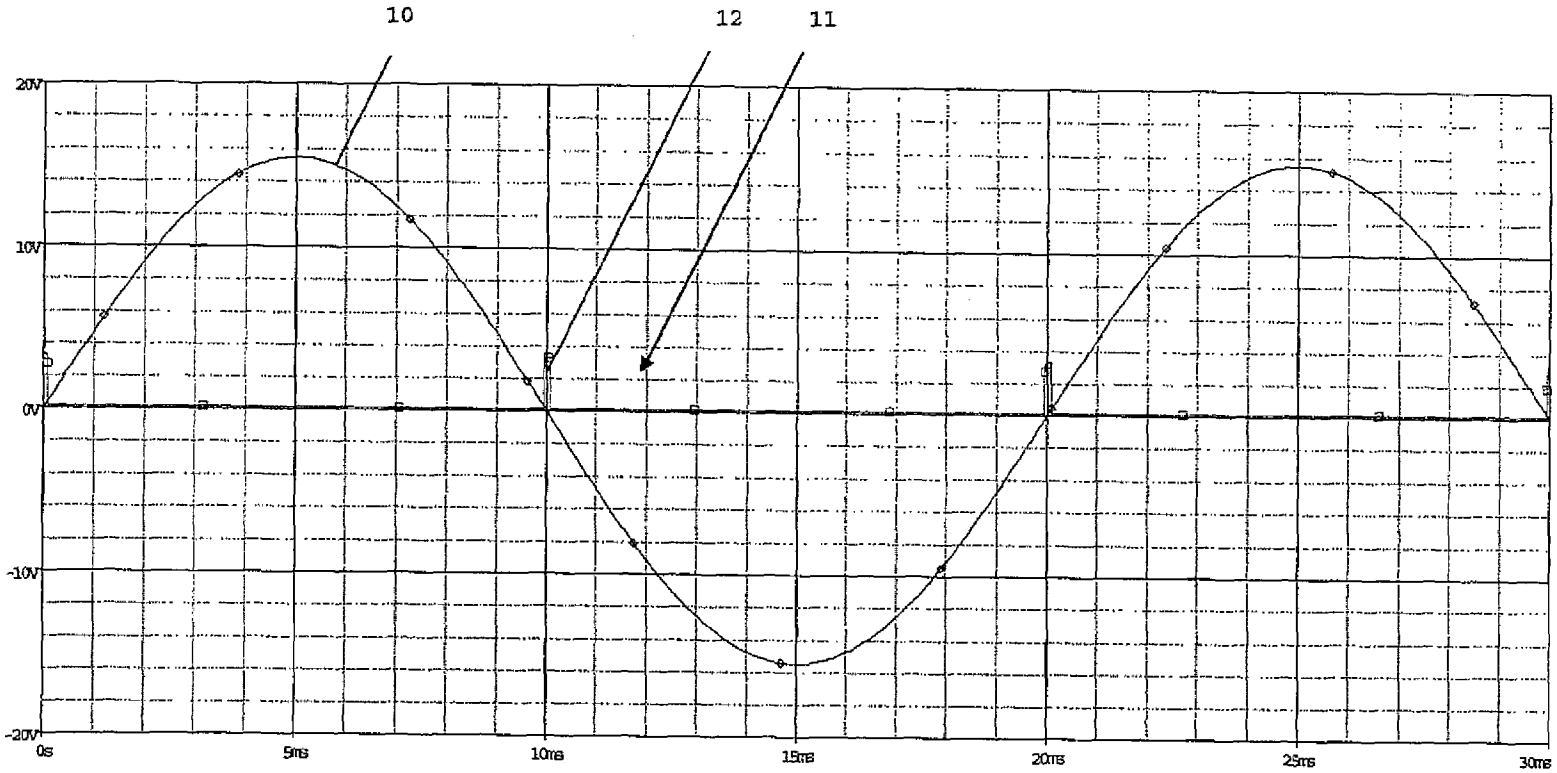
Fig. 3 (PRIOR ART)
FIG. 3 shows examples of waveforms in an example of a controller.

FIG. 3 shows an example of a waveform in an interface circuit such as the one shown in FIG. 2. A control signal 10 has a frequency of 50 Hz and thus a period duration of 20 ms. The interface signal 11 is provided with individual pulses 12 only at the zero crossing points of the control signal 10. The fault-free case is shown in the illustration. The interface signal on the secondary side of the optocoupler Q4*a* can now be evaluated with respect to the detected zero crossing points. A conclusion can thus be made about the activation of the push button based on the detected sequence of the zero crossing points, because a line voltage was supplied to the interface circuit for a certain period of time (for example in the range from 400 to 1,000 milliseconds).

Due to interferences, steep waveforms can be created in the areas of the zero crossing points. The duration of the pulse is in this case drastically reduced. This can occur to such an extent that the optocoupler Q4*a* shown in FIG. 2 can then no longer properly transmit the signal.

For detection of the zero crossing points are typically provided threshold values of −6.5 V to 6.5 V for the amplitude of the line voltage. These threshold values should not be changed because the interface is advantageously used also for DALI signals and the digital LOW signal is with the DALI method below 6.5 V. The problem area addressed by the invention thus in particular relates to interfaces for controllers for lighting means which should handle both digital signals and alternating voltage signals.

It may therefore happen that zero crossing points of such operation devices are not detected, which leads to erroneous control that can gradually occur in a progressively more drastic manner when several devices are addressed from the same push button activation, which can then as a result of different interferences perform on their lines different drive operations with the devices that are connected to the same push button or switch. An alleviation of this problem can be achieved when, in addition to the detection of zero crossing point, detection of the peak value range of the line voltage is also performed. Thus, for example, a relatively long peak value, which is still in the range of the maximum line voltage values, in addition to the relatively short pulses, can be generated in the range of the zero crossing points, which can improve reliability of the control.

However, a problem in this respect is that with different sizes of the network amplitudes, different pulses will be generated in the range of the peak values of the line voltage. Moreover, with an open line, which is to say when the push button is not pressed, or when the voltage is capacitively coupled to a switch that is turned on, a failure may result when the generated signal can no longer be distinguished from a pressed switch or push button. Such switching errors are in particular common with long line lengths.

Figure 4:
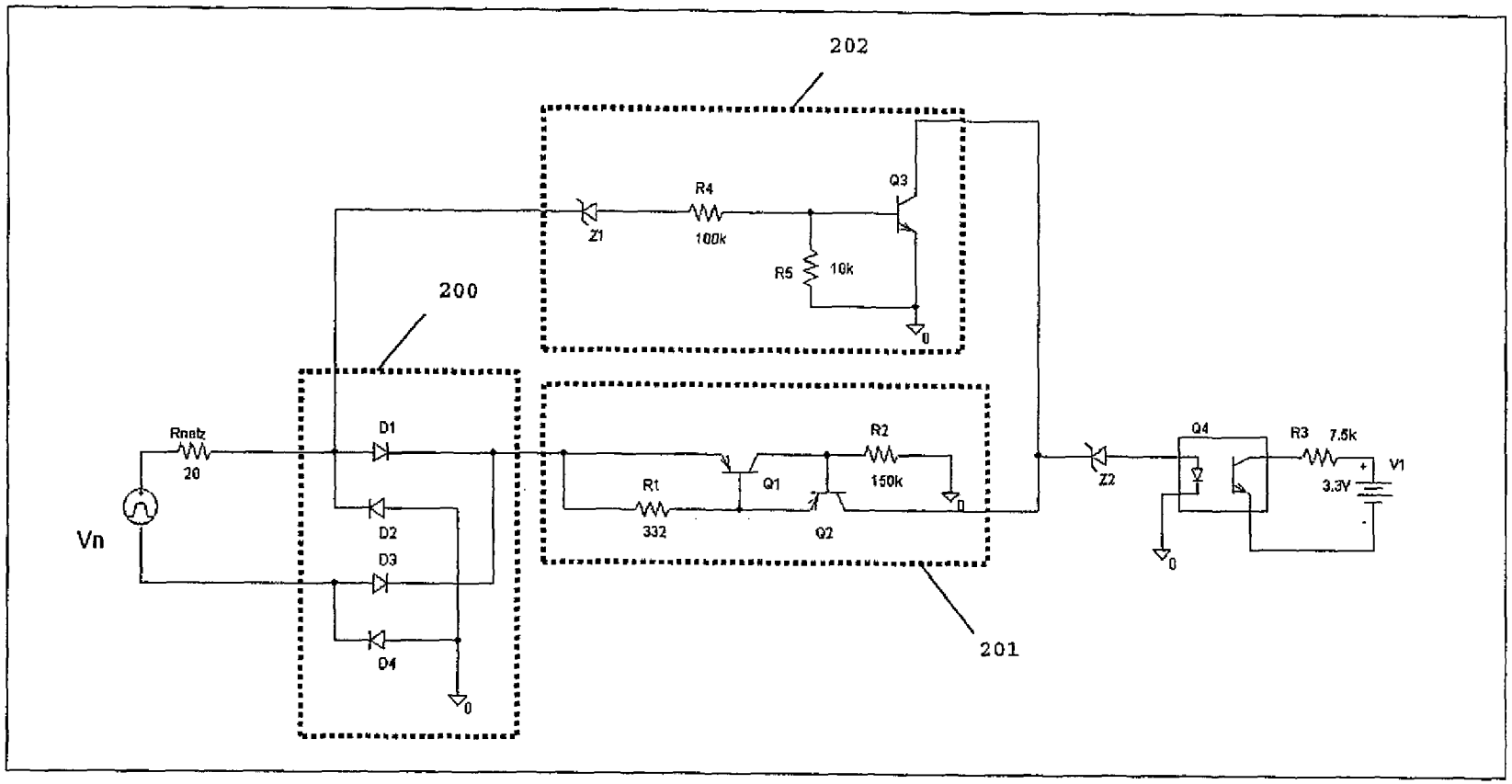
FIG. 4 shows an embodiment of the controller according to the invention.

FIG. 4 shows an embodiment of the controller according to the invention for a lighting means. As one can see also in the controller according to FIG. 2, switched line voltage Vn is supplied via a resistor $R_{netz}$ for example with 20Ω to a rectifier circuit 200. The rectifier circuit 200 in this case substantially corresponds to the rectifier circuit 100 from FIG. 2. Four diodes D1-D4 are connected in a customary bridge rectifier circuit to ground. The rectified control signal is transmitted by the rectifier circuit 200 to the zero crossing detection circuit 201. This substantially corresponds to the zero crossing detection circuit 101 of FIG. 2. A first resistor R1 with for example 32Ω and the emitter of a first transistor Q1 are impacted by the rectified signal. The second side of the resistor R1 is connected with the base of this first transistor Q1. The collector of the first transistor Q1 is connected with the base of a second transistor Q2.

Further, the base of the first transistor Q1 of the first transistor Q1 is connected with the emitter of the second transistor Q2. Moreover, the base of the second transistor Q2 is also connected with the first side of a second resistor R2 with for example 150 kΩ. This resistor R2 is connected to ground. The output signal of this zero crossing detection circuit is applied to the collector of the transistor Q2 and it is thus supplied to a Zener diode Z2.

The control signal Vn is further supplied through the network resistor $R_{Netz}$ to a peak value detection circuit 202. Next, it passes through a Zener diode Z1. Since the Zener diode forms with its predetermined breakdown voltage a sort of a threshold value switch, and since it is switched on only when a predetermined threshold value has been exceeded, only the peak values above a predetermined upper threshold value of one of both half-waves of the alternating voltage signal will pass through the Zener diode Z1. Signal components which are below the breakdown voltage of the Zener diode Z1, which is to say below the predetermined upper threshold value, will not be forwarded. This includes in particular the second half-wave of the alternating voltage signal Vn. Instead of the Zener diode Z1, it is also possible to use a resistor divider which is dimensioned for the threshold voltage of the transistor Q3.

The resulting signal is supplied through an ohmic resistor R4 with for example 100 kΩ to the base of a transistor Q3. The emitter of the transistor Q3 is coupled back through an ohmic resistor R5 with for example 100kΩ to the base of the transistor Q3 and then connected to ground. This feedback transistor Q3 ensures a uniform rectangular pulse shape. The output signal of the peak value detection circuit 202 is applied to the collector of the transistor Q3 and it is also supplied by it to Zener diode Z2.

The signal which is applied to Zener diode Z2 is transmitted in the same manner as shown also in FIG. 2 through an optocoupler Q4, which is supplied through a resistor R3 with for example 7.5 kΩ, and with a supply voltage V1 having for example 3.3 V, to the control circuit. The actual transmission of the interface signal is carried out by a secondary part of the optocoupler Q4, not shown in the illustration.

Figure 5:
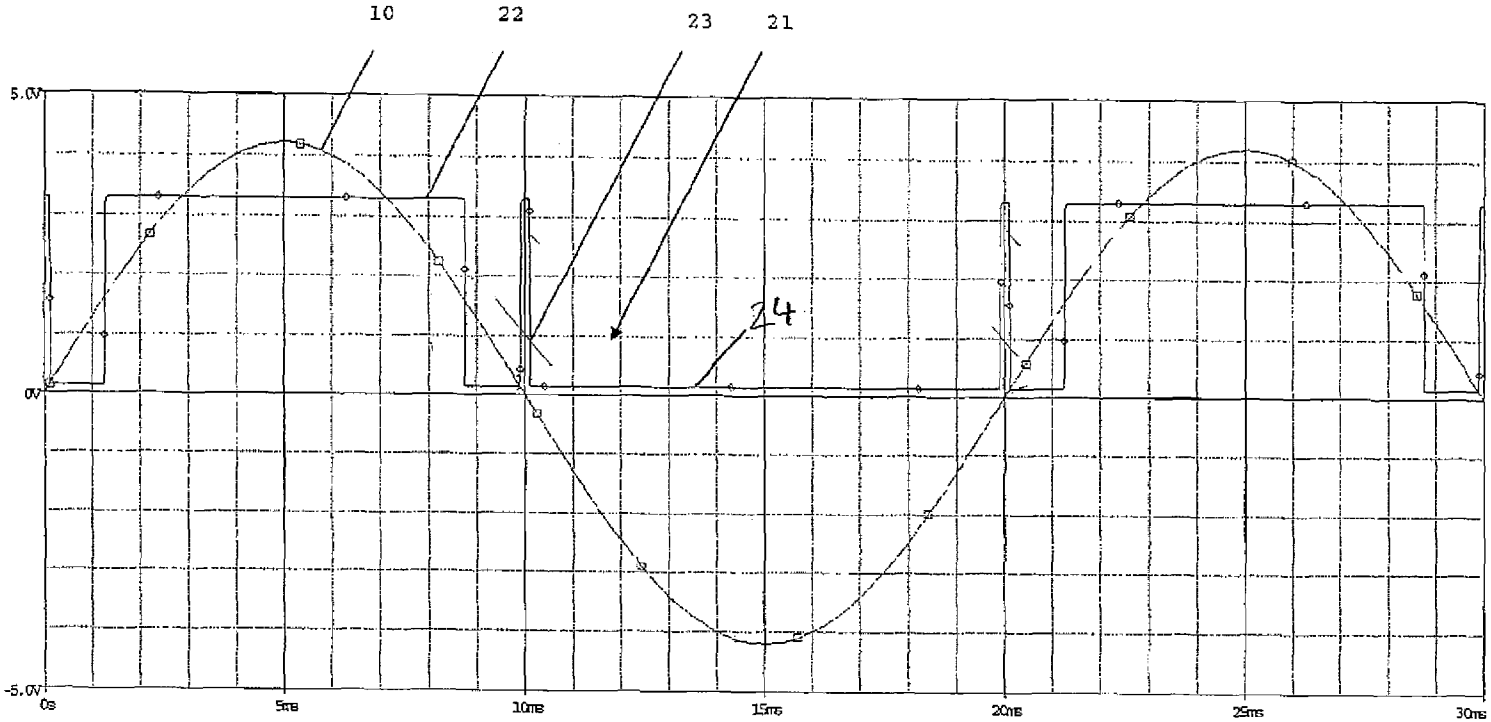
FIG. 5 shows a first example of a waveform in an embodiment of the controller according to the invention.

One resulting signal of the interface circuit of FIG. 4 can be seen in FIG. 5. FIG. 5 thus shows the control signal 10 and at the same time, also the interface signal 21 which corresponds to the output signal of the optocoupler. For clarity's sake, a different scale was employed for these signals. The interface signal 21 comprises the pulses 23 at the zero crossing points of the control signal 10, as well as the wide pulses 22 in the range of the peak value of the positive half-wave of the control signal 10 (which is to say when the upper threshold value is exceeded). Through a connection to the peak value detection circuit 202 of the inverted input of the rectifier circuit 200, a wide pulse 22 is obtained at the level of the negative half-wave of the alternating voltage signal 10.

The pulses 23 are obtained at the zero crossing points of the control signal 10 because the zero crossing detection circuit 201 allows in combination with the Zener diode Z2 a current to pass through only when the voltage of the control signal 10 has exceeded a certain potential (both in the positive and in the negative direction). As long as the voltage of the control signal 10 is so small that the zero crossing detection circuit 201 in combination with the Zener diode Z2 still does not contribute to any current flowing in the primary side of the optocoupler Q4, since the threshold voltage of the Zener diode Z2 is not reached, the optocoupler Q4 is not controlled in this manner and an interface signal 21 is thus at a high signal level (23), which is interpreted as a logical "1".

When the voltage of the control signal 10 has exceeded a certain potential (hereinafter referred to as the lower threshold value, due to the rectifier D1-4, both in the positive and in the negative direction), the current flowing through the zero crossing detection circuit 201 is sufficient in order to control also the Zener diode Z2 and a current will thus flow through the primary side of the optocoupler Q4, so that the optocoupler Q4 is controlled also on the secondary side. Therefore, an interface signal 21 is maintained at a lower level 24 on the secondary side, which is interpreted as a logical "0".

When the push button is pressed and the voltage of the control signal 10 is not in the immediate vicinity of the zero crossing, a current will flow due to the activation of the zero crossing detection circuit 201 in combination with the Zener diode 22 through the primary side of the optocoupler Q4 and the optocoupler Q4 will also control the secondary side. An interface signal 21 is thus applied on the secondary side with a lower level 24, which is interpreted as a logical "0".

When a line voltage is applied because the push button is pressed, the interface signal 21 will be applied at a lower level 24 during the negative half-wave for a majority of this half-wave, which can be interpreted as a logical "0". The application of line voltage is preferably detected so that for the interface signal 21, a signal with a low threshold 24 is applied regularly for the duration of almost a half-wave of the network, i.e. at least 9 ms. In this manner, the application of line voltage, which is to say activation of the push button, can be effected through the evaluation of a longer phase of the application of a signal having a low level 24 (namely reception of a logical "0").

When the push button is not pressed, which means that an open line is present, capacitive interference signals can be coupled with a correspondingly longer line. However, this coupled line voltage will thus never reach the switching threshold of the Zener diode Z1, so that this branch is never active, which is to say that the transistor Q3 is never switched through, which would cause the switching point before the Zener diode Z2 to draw a voltage of 0 V.

Instead, the bipolar coupled interference voltage only provides a contribution in the branch after that rectifier with the diodes D1-D4, and as long as the coupled voltage is at least sufficient, this voltage exceeds the lower threshold value and the zero crossing detection circuit 201 thus permits in combination with the Zener diode Z2 the passage of a current.

Each rectified half-wave of the control signal Vn thus generates a certain current flow once the lower threshold value has been exceeded by means of the transistors Q1 and Q2 at the input of the optocoupler Q4. A current flowing through the primary side of the optocoupler Q4 is, at the output side, interpreted as a logical "0" (similarly to the DALI standard, which results in the high state in a voltage of more than 0 V). However, the duration of such a signal with a logical "0" is only in the range below 5 ms. An interference signal when the switch is not pressed can also result when a detection method based on the zero crossing points according to prior art is used in that each half-wave current can flow through, which can then be interpreted as a zero crossing on the output side.

Figure 6:
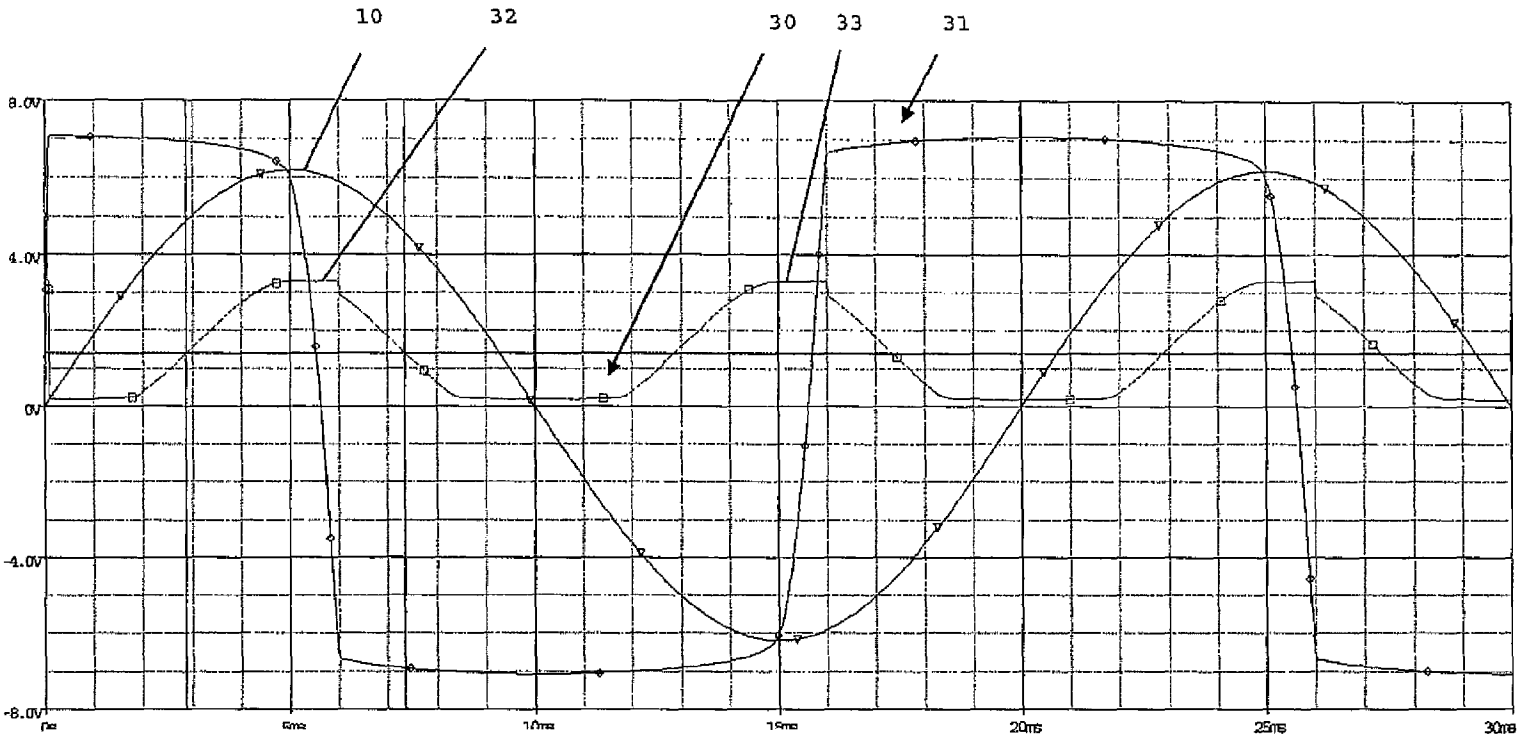
FIG. 6 shows a second example of a waveform in an embodiment of the controller according to the invention.
Figure 7:
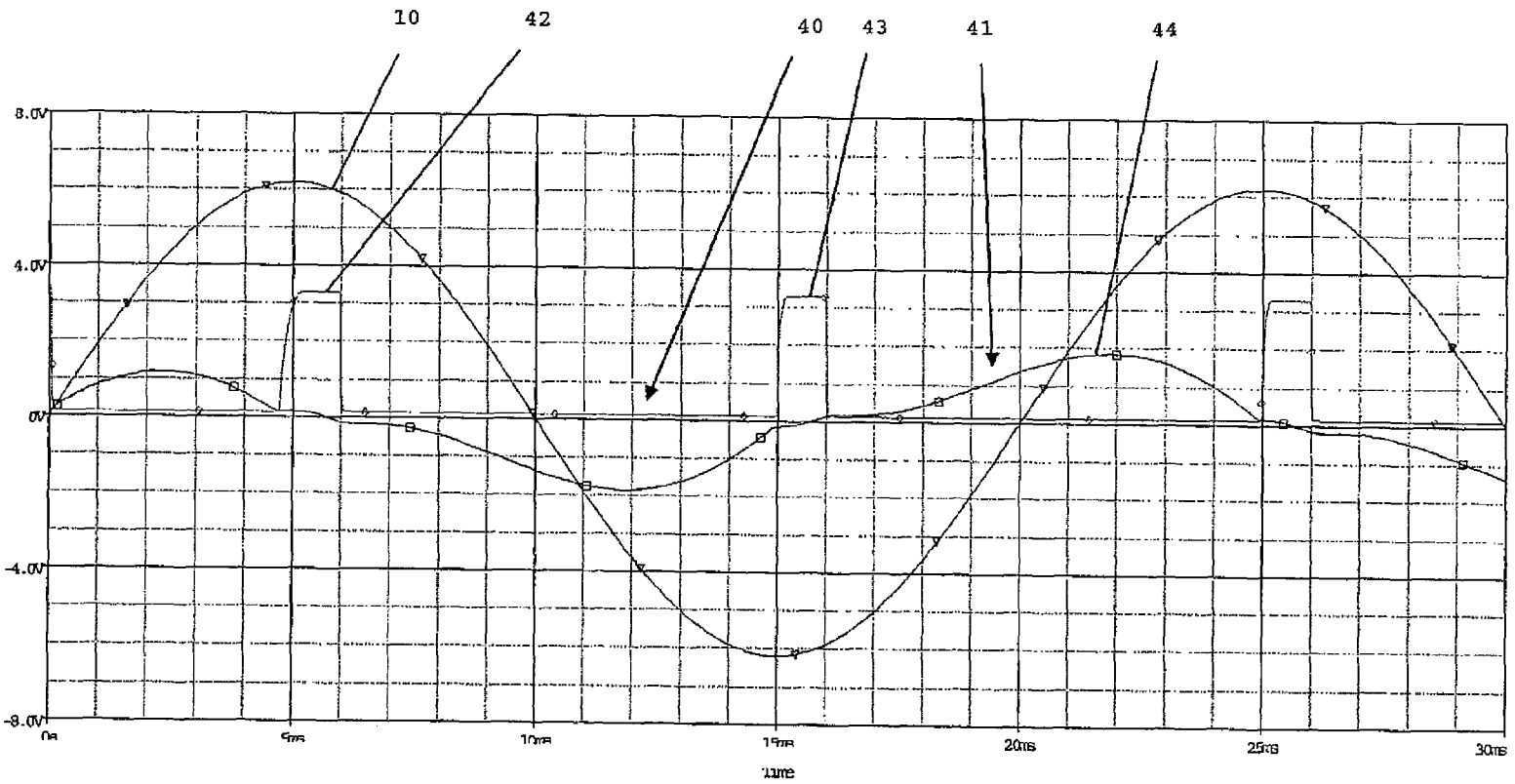
FIG. 7 shows a third example of a waveform in an embodiment of the controller according to the invention.

In FIG. 6 an example of a waveform obtained with the controller according to FIG. 4 is shown with an open line and with a capacitive disturbance. The capacitively coupled line voltage 31 is provided with a phase shift of 90° relative to the control signal 10. Since the push button is not pressed, the interface switch does not detect any zero crossing of the actual line voltage 10. Instead, the zero crossing points of the capacitively coupled signal 31 are detected in the interface signal 30, which corresponds to the output signal of the optocoupler. This will thus result in pulses 32, 33 in the interface signal. However, since there are no long pulses in the interface signal which would exceed the upper threshold vale (peak values) of each of the corresponding half-waves, and/or no prolonged phase with a low level, the drive circuit will accept the subsequent signal as an invalid signal and thus not as an instruction for activation of the switch or of the push button.

In contrast to that, when a real line voltage is applied as control signal by pressing the switch or the push button, the switching threshold of the Zener diode Z1 (upper threshold value) is exceeded and the transistor Q3 is switched through, wherein the point before the Zener diode Z2 is applied with a drawn voltage of 0 V, which will be in turn interpreted on the output side in the interface signal 30 as a logical "1". With a half-wave which has reversed polarity, the upper switch branch will not be provided, which is to say that the transistor Q3 will never be switched through. Instead, for the majority of this network half-wave, this will always result based on the zero crossing detection circuit 201 in combination with the Zener diode Z2 in a current flow by means of the transistors Q1, Q2, which will be interpreted on the output side as a logical "0".

Therefore, a difference between the half-waves which have a different polarity is created only when the actual line voltage is applied, but not with a coupled interference voltage. Only when a half-wave is present, a logical "1" will be applied on the output side due to the activation of the upper switch branch. On the other hand, with a coupled interference voltage, regardless of the polarity of the half-waves, a current will flow depending only on the amplitude of the coupled interference voltage always for a significantly shorter time period than the time period of one half-wave, which is to say that the a logical "0" will be always applied on the output side, when the current is flowing.

A logical "0" with a time period above a threshold value of for instance at least 9 ms during a first half-wave can be also generated only when a certain line voltage is applied. When the zero crossing points are filtered out, the pulses having the level of a logical "0", namely a low level, will last for at least 10 ms. In addition, the upper switch branch with the Zener diode Z1 will be activated only when a certain line voltage is applied. This means that a current will flow on the primary side with an interference voltage for a significantly shorter time period than the duration of a network half-wave. When a line voltage is generated intentionally by activating the push button, a current will flow at least in each second half-wave for almost the entire duration of this half-wave in the lower branch 201, and no current will flow in the optocoupler in each second half-wave (predetermined duration) in which the power amplitude is above the threshold voltage of the Zener diode Z1. Therefore, for discrimination, it is necessary to determine the state of the activation of the switch, namely that no current flows in the optocoupler Q4 during certain segments in each second half-wave, and/or that a current is still flowing in the optocoupler in the other half-wave as long as certain threshold values, for example −6.5 V or +6.5 V, have been exceeded.

Therefore, this also makes it possible to detect that the interface circuit has exceeded the lower threshold value for at least the majority of the duration of one of two half-waves of the control signal 10, and that the interface circuit 2 generates a signal pulse having a lower level 24 in the interface 21 each time when it is detected that the lower threshold has been exceeded, and that a low level 24 of an interference signal is detected with repeated sequences of several such signal pulses.

FIG. 7 shows again an example of a waveform generated in the controller according to FIG. 4 with an open line having the length of 350 m.

The control signal 10 is in this case not applied to the input of the interface circuit. Instead, only a coupled signal 41 is applied. The pulses 42, 43 of the interface signal 40 keep becoming shorter when the line is becoming longer. However, it is still possible to obtain a reliable distinction between intentionally applied line voltage and coupled signals.

Figure 8:
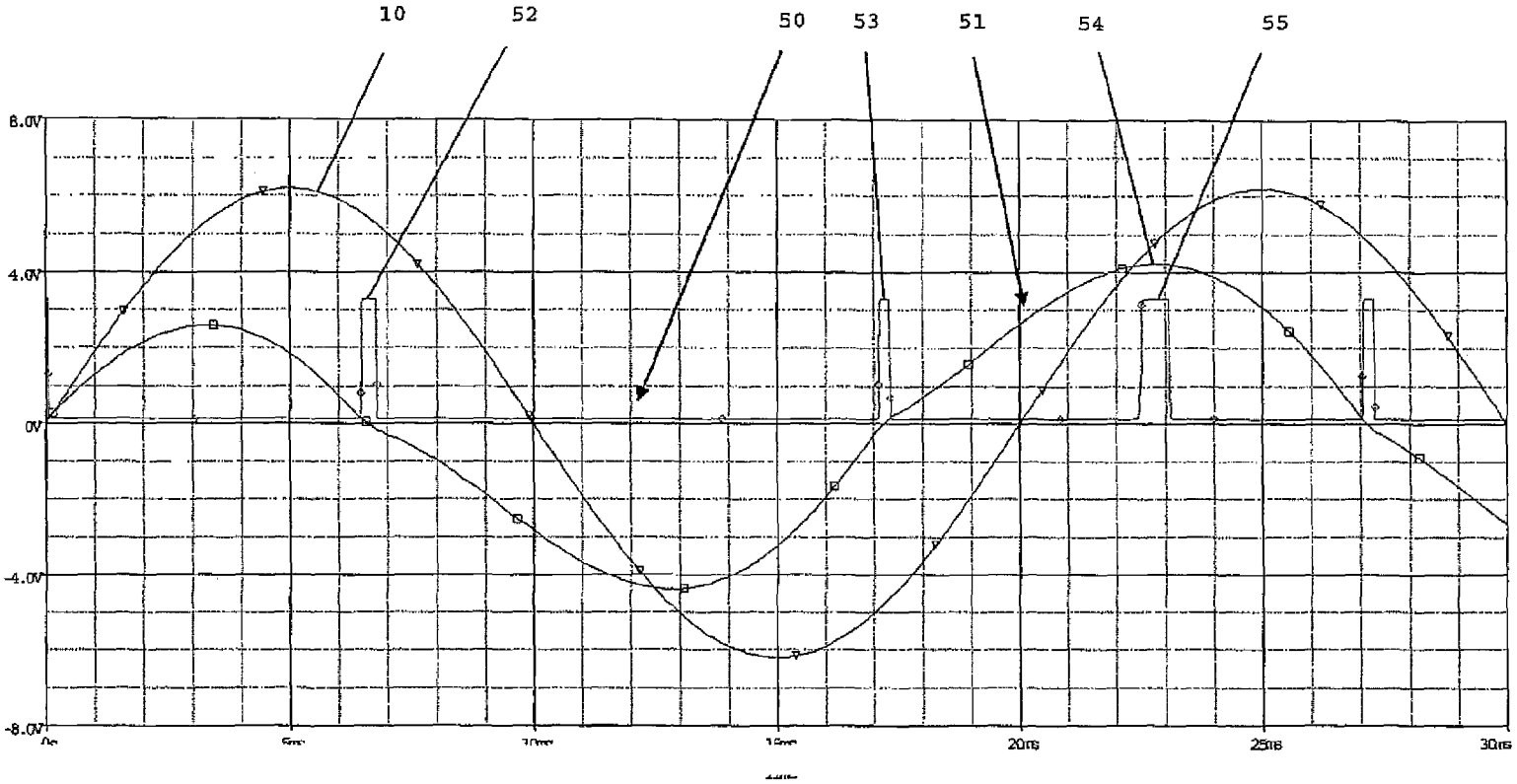
FIG. 8 shows a fourth example of a waveform in an embodiment of the controller according to the invention.

In FIG. 8, however, it is assumed that an open line having a length of at least 550 m is used. The peak value 54 of the coupled signal 51 does not reach in this case a level that would exceed the breakdown voltage of the Zener diode Z1 of FIG. 4. Pulses 55 are thus generated also when a line signal 10 is applied in the region of one half-waves of the coupled signal 51. In addition, pulses 52, 53 are generated in the region of the zero crossing points of the coupled signal 51. A distinction between a coupled signal 51 and an applied line signal 10 is thus no longer possible. In particular, due to the phase shift between the line signal 10 and the coupled signal 51, an asynchronicity is obtained between different connected devices as well as switching errors. However, the line lengths of more than 500 m are unusual for lamps or lighting installations, which means that such a case does not have to be further considered.

Figure 9:
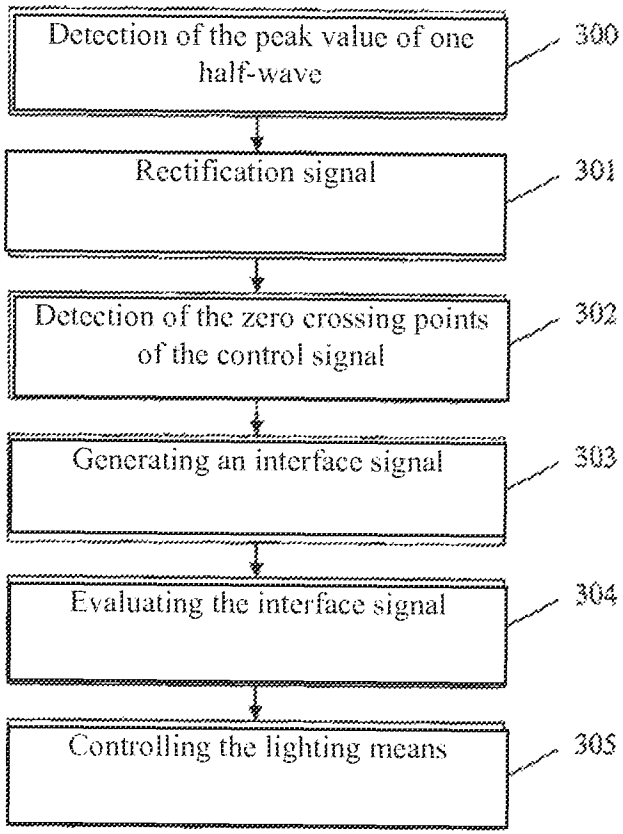
FIG. 9 shows an embodiment of the method according to the invention.

FIG. 9 shows an embodiment of the method according to the invention. In a first step 300, the peak values of each of two half-waves of a control signal are detected. All values above a threshold voltage are considered as peak values. In a second step 301, the control signal is rectified. The resulting rectified control signal consists of a series of successive half-waves which have an identical sign.

In an optional third step 302, the zero crossing points of the control signal are detected, so that the zero points of the rectified control signal are detected. In an alternative variant, the zero crossing points of the control signal may be also simply filtered out (for example by filtering out pulse durations of less 150 μm). In a fourth step 303, the detected peak values (exceeding the upper threshold values) and the activation of the lower branch 202, and optionally the detected zero crossing points, are summarized in a common interface signal. In a fifth step 304, the interface signal is evaluated with respect to logical states and to the switching events which are branched in this manner. In a sixth step 305, the lighting means is controlled according to the control specifications determined in the previous step.

The invention is not limited to the illustrated embodiment. Different lighting means can be controlled according to the invention. The use of different types of input devices, such as for example touch-sensitive displays, etc., is also conceivable. All the features described above or the features shown in the figures can be advantageously combined with each other in the context of the invention.

The invention claimed is:

1. Controller (1) for a lighting device (5), wherein the controller (1) is equipped with an interface circuit (2) and with a drive circuit (3), where the interface circuit (2) generates in response to a control signal (Vn, 10) an interface signal (21, 31, 41, 51), and where the drive circuit (3) drives the lighting device (5) depending on the interface signal (21, 31, 41, 51), where the control signal (Vn, 10) is an alternating voltage signal generated outside of the controller (1), wherein the interface circuit (2) detects when an upper threshold value has been exceeded only in one of two half-waves of the control signal (Vn, 10), and that the interface circuit (2) generates for each detection of the case when the upper threshold value has been exceeded, a first signal pulse (22, 55) in the interface signal (21, 31, 41, 51), and detects that a lower threshold value (24) of the other of the two half-waves has been exceeded.

2. Controller (1) according to claim 1, wherein the control signal (Vn, 10) is provided with a first switching state and with a second switching state, the first switching state is the alternating voltage signal, and the second switching state is an absence of the alternating voltage signal.

3. Controller (1) according to claim 1, wherein the interface circuit (2) includes a peak value detection circuit (202), the peak value detection circuit (202) detects that the upper threshold value of a positive or negative half-wave of the control signal (Vn, 10) has been exceeded, and the peak value detection circuit (202) generates the first signal pulse (22, 55) in the interface signal (21, 31, 41, 51).

4. Controller (1) according to claim 1, wherein the first signal pulse (22, 25) has a length of at least 1 ms, and the first signal pulse (22, 55) has a length of, at the most, 10 ms.

5. Controller (1) according to claim 1, wherein the interface circuit (2) contains a zero crossing detection circuit (201), the zero crossing detection circuit (201) detects in combination with a Zener diode (Z2) that the lower threshold value of the control signal (Vn, 10) has been exceeded, and the zero crossing detection circuit (201) generates, for each detection of the case when the lower threshold value of the control signal (Vn, 10) has been exceeded, a second signal pulse with a low level (24) in the interface signal (21, 31, 41, 51).

6. Controller (1) according to claim 5, wherein the second signal pulse (24) has a length of at least 9 ms.

7. Controller (1) according to claim 1, wherein the interface circuit (2) contains a rectifier circuit (200), and the rectifier circuit (200) rectifies the control signal (Vn, 10).

8. Method for operating a lighting device (5), wherein an interface signal (21, 31, 41, 51) is generated depending on a control signal (Vn, 10), and where the lighting device (5) is controlled depending on the interface signal (21, 31, 41, 51), where the control signal (Vn, 10) is an alternating voltage signal generated outside of the controller (1), wherein exceeding an upper threshold value is detected of only one of two half-waves of the control signal (Vn, 10), and for each detection of when the upper threshold value has been exceeded, a first signal pulse (22, 55) is generated in the interface signal (Vn, 10), and exceeding of a lower threshold value of the other of the two half-waves is detected.

9. Method according to claim 8, wherein the control signal (Vn, 10) is provided with a first switching state and with a second switching state, the first switching state is the alternating voltage signal, and the second switching state is an absence of the alternating voltage signal.

10. Method according to claim 8, wherein the first signal pulse (22, 55) has a length of at least 1 ms, and the first signal pulse (22, 55) has a length of, at the most, 10 ms.

11. Method according to claim 8, wherein the zero crossing points of the control signal (Vn, 10) are detected, and for each detection of the case when the lower threshold value is detected, a second signal pulse (24) is generated in the interface signal (21, 31, 41, 51).

12. Method according to claim 11, wherein the second signal pulse (24) has a length of at least 9 ms.

13. Method according to claim 8, wherein the control signal (Vn, 10) is rectified.

14. Controller (1) for a lighting device (5), where the controller (1) is equipped with an interface circuit (2) and with a drive circuit (3), where the interface circuit (2) generates an interface signal (21, 31, 41, 41) depending on a control signal (Vn, 10), and where the drive circuit (3) controls the lighting device (5) depending on the interface signal (21, 31, 41, 51), where the control signal (Vn, 10) is an alternating voltage signal generated outside of the controller (1), wherein the interface circuit (2) detects when a lower threshold value has been exceeded for at least the majority of the duration of one of two half-waves of the control signal (Vn, 10), and the interface circuit (2) generated for each detection of the case when the lower threshold value has been exceeded, a signal pulse with a low level (24) in the interface signal (21, 31, 41, 51), and with a repeated succession of a plurality of such signal pulses having a low level (24), the application of the control signal (Vn, 10) is detected.

* * * * *